US010264365B2

(12) United States Patent
Eichfeld et al.

(10) Patent No.: US 10,264,365 B2
(45) Date of Patent: Apr. 16, 2019

(54) USER-SPECIFIED OCCLUDING IN-EAR LISTENING DEVICES

(71) Applicant: Bose Corporation, Framington, MA (US)

(72) Inventors: Jahn Dmitri Eichfeld, Natick, MA (US); Ryan Termeulen, Watertown, MA (US); Ryan Silvestri, Franklin, MA (US)

(73) Assignee: BOSE CORPORATION, Framingham, MA (US)

( * ) Notice: Subject to any disclaimer, the term of this patent is extended or adjusted under 35 U.S.C. 154(b) by 28 days.

(21) Appl. No.: 15/483,632

(22) Filed: Apr. 10, 2017

(65) Prior Publication Data

US 2018/0295455 A1 Oct. 11, 2018

(51) Int. Cl.
*H04R 25/00* (2006.01)

(52) U.S. Cl.
CPC ..... *H04R 25/505* (2013.01); *H04R 25/305* (2013.01); *H04R 25/353* (2013.01); *H04R 25/554* (2013.01); *H04R 25/652* (2013.01); *H04R 25/70* (2013.01); *H04R 25/558* (2013.01); *H04R 2460/11* (2013.01)

(58) Field of Classification Search
CPC .. H04R 25/505; H04R 25/554; H04R 25/305; H04R 25/353; H04R 2460/11
See application file for complete search history.

(56) References Cited

U.S. PATENT DOCUMENTS 4,718,099 A 1/1988 Hotvet
4,870,688 A * 9/1989 Voroba ..... H04R 25/656 381/322
5,577,511 A 11/1996 Killion
5,724,433 A 3/1998 Engebretson et al.
8,532,320 B2 * 9/2013 Nordahn ..... H04R 25/70 381/23.1
8,687,833 B2 * 4/2014 Probst ..... H04R 25/652 381/322
9,131,321 B2 9/2015 Sabin
2008/0063228 A1 3/2008 Mejia et al.
2010/0166241 A1 * 7/2010 Sabio ..... H04R 25/656 381/328

FOREIGN PATENT DOCUMENTS

EP 2640095 A1 9/2013

OTHER PUBLICATIONS

Curran, Jim, "A Forgotten Technique for Resolving the Occlusion Effect", Innovations: vol. 2, Issue 2, 2012, 7 pages, reprinted at StarkeyHearingTechnologies.com.
International Search Report and Written Opinion in PCT/US18/26448 dated Jun. 11, 2018; 15 pages.

* cited by examiner

*Primary Examiner* — Brian Ensey
(74) *Attorney, Agent, or Firm* — Schmeiser, Olsen & Watts LLP

(57) ABSTRACT

A system for configuring a hearing device comprises an in-ear listening device; a plurality of customization components for use with the in-ear listening device, each customization component when in combination with the listening device cooperating with the listening device to define a controlled amount of venting; and a self-fitting assistance processing device in communication with the in-ear listening device, which adjusts a gain of the in-ear listening device according to the amount of venting provided by a selected one of the customization components.

20 Claims, 7 Drawing Sheets

USER-SPECIFIED OCCLUDING IN-EAR LISTENING DEVICES

BACKGROUND

This description relates generally to in-ear listening devices, and more specifically, to systems and methods for selecting an ear tip for a hearing aid, earphone, or similar in-ear listening device according to a user-defined balance of occlusion and gain.

BRIEF SUMMARY

In accordance with one aspect, a system for configuring a hearing device comprises an in-ear listening device; a plurality of customization components for use with the in-ear listening device, each customization component when in combination with the listening device cooperating with the listening device to define a controlled amount of venting; and a self-fitting assistance processing device in communication with the in-ear listening device, which adjusts a gain of the in-ear listening device according to the amount of venting provided by a selected one of the customization components.

Aspects may include one or more of the following features. The customization components may comprise ear tips configured for removably coupling to the in-ear listening device. The controlled amount of venting may be controlled by a passage through the ear tip. The in-ear listening device may be constructed and arranged as an earbud, and the customization component may be a component of the earbud that controls dimensions of a passage through the earbud. The self-fitting assistance processing system may automatically adjust a tuning parameter. The tuning parameter may be at least one of a dynamic range compression parameter, equalization parameter, output limit, bandwidth limit, a gain limit, feedback filter design, or feed-forward filter design. The self-fitting assistance processing system may include a user interface that displays a recommendation result regarding the selected customization component. Each of the plurality of customization components may have a unique effect on occlusion caused by the in-ear listening device, and the self-fitting assistance processing system may balance gain against the occlusion. The self-fitting assistance processing device may adjust a gain of the listening device to determine a balance between quality of a voice of a user of the in-ear listening device including the effect of the venting provided by the selected customization component and a maximum amount of stable gain supported by the venting. The in-ear listening device may include a processor that enhances a sound received by the in-ear listening device in response to an input received from the self-fitting assistance processing device. The self-fitting assistance processing device may remotely control the in-ear listening device. The in-ear listening device may include a sensing device that receives and processes signals for identifying the selected customization component.

In accordance with another aspect, a method for configuring a hearing device comprises selecting and attaching a customization component providing a controlled amount of venting to an in-ear listening device; adjusting an amount of gain applied to signals by the in-ear listening device according to the amount of venting provided by the selected customization component; and determining whether the amount of venting is acceptable based on both the gain allowed by the in-ear listening device and an amount of occlusion experienced by a user.

Aspects may include one or more of the following features. The method may further comprise automatically detecting the selected customization component, wherein adjusting the gain may comprise adjusting the gain within a gain range limit permitted by the in-ear listening device. Adjusting the gain of the in-ear listening device may comprise identifying the customization component that was selected; and adjusting the gain according to an identified amount of venting provided by the customization component. The gain may be adjusted to determine a balance between quality of a voice of a user of the in-ear listening device including the identified amount of venting and a maximum amount of stable gain supported by the identified amount of venting. The in-ear listening device may include a sensing device for automatically identifying the attached customization component. The method may further comprise performing a combination of manual and automatic sensing, including automatic sensing and monitoring of use and recommended changes after initial use.

In another aspect, a hearing device comprises an earbud including an acoustic driver; an ear tip constructed and arranged for positioning between the earbud and an ear canal of a wearer; the combination of earbud and ear tip providing a controlled amount of venting between the ear canal of the wearer and the outside environment; and a gain control device that adjusts the gain of the hearing device according to the controlled amount of venting. Aspects may include one or more of the following features. The controlled amount of venting may result in a unique amount of occlusion caused by the hearing device, and the gain control device may adjust a gain of the hearing device to determine a balance between quality of a voice of a user of the hearing device including the occlusion, and a maximum amount of stable gain supported by the controlled amount of venting. The hearing device may further comprise a sensing device for automatically identifying the combination of earbud and ear tip and the corresponding controlled amount of venting.

BRIEF DESCRIPTION

The above and further advantages of examples of the present concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

A common problem with conventional in-ear listening devices concerns the occlusion effect, which occurs when low frequency sound from the vibrating walls of the ear canal, such as that produced by the wearer's own voice, is amplified due to the sound being trapped in the ear canal by the listening device blocking the ear canal. The seal that results in occlusion is helpful, however, because it prevents the creation of a positive feedback loop between the listening device output and any external microphones it uses for detecting and reproducing ambient sound. Preventing instability, i.e., this positive feedback, allows the listening device to apply a higher gain to the external sound, increasing the range of hearing loss the device can address, or the amount of augmented perception it can provide to a normal-hearing user. An occluding seal is also beneficial in providing passive attenuation of ambient sound, either for noise-reduction purposes or to improve the quality of the device's control over what the user hears. The amount of occlusion can be controlled by providing a vent through the listening device structure. Vents allow the designer more control over the amount of occlusion than configuring the sealing structure to seal less than perfectly.

Figure 5:
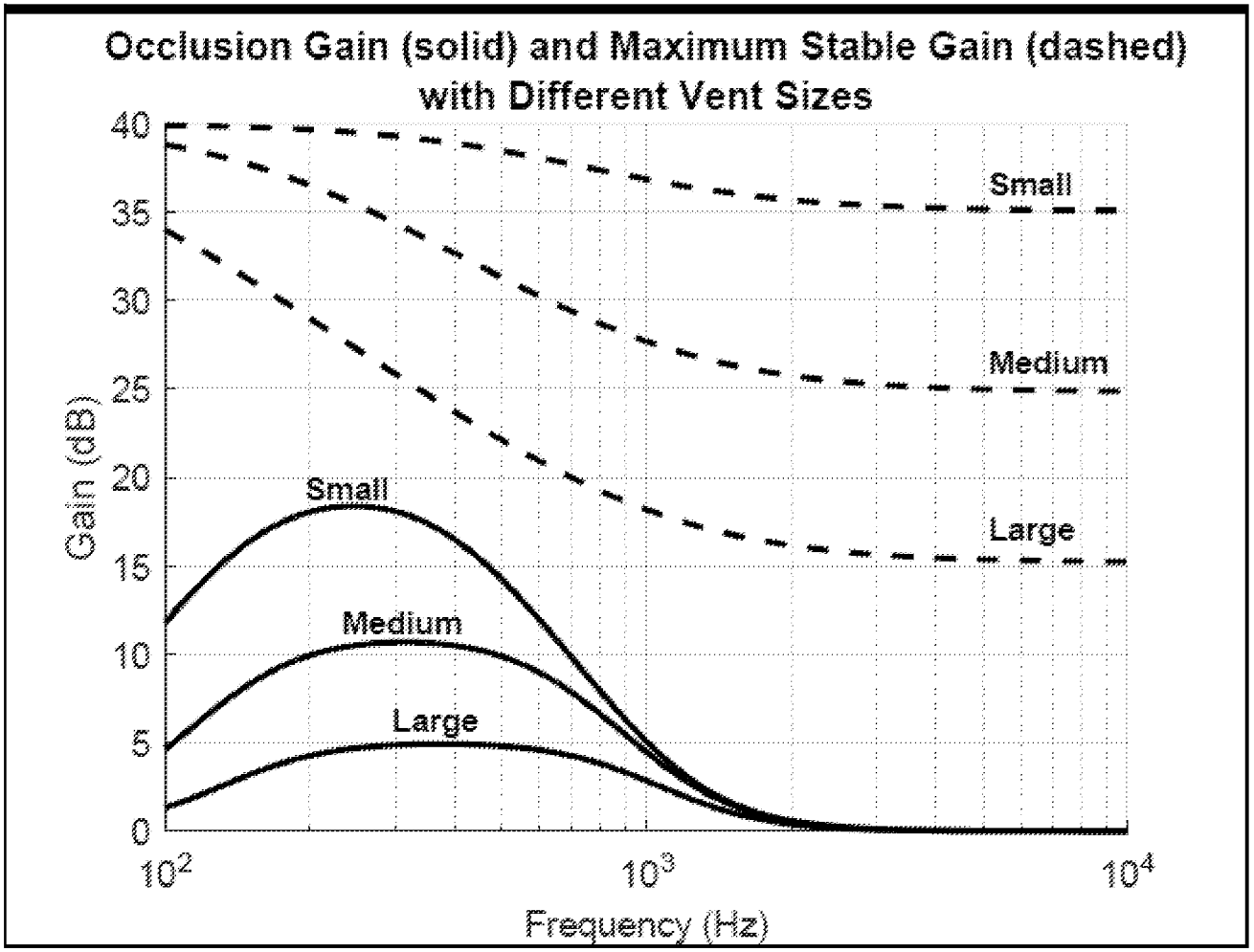
FIG. 5 is a graph illustrating changes in occlusion and maximum stable gain produced by an in-ear listening device due to different vent sizes, in accordance with some examples.

Hearing-impaired users can often tolerate some occlusion because they are less sensitive to the occlusion-amplified sound. These users may desire an increased gain, and may therefore select a listening device with greater occlusion to preserve stability while applying high gain. Such users may therefore desire a high gain, e.g., greater than 30 dB, and require a smaller vent, also referred to as a port, and more specifically, a smaller vent size, to reduce acoustic feedback caused by leakage from the device's transducer. The effect of vent size on the maximum possible gain is illustrated in the graph of FIG. 5.

However, it is difficult to predict exactly who will suffer from the occlusion effect for a particular vent diameter. Other users, e.g., non-hearing-impaired users or those with less hearing loss, are more sensitive to the occlusion effect, and may therefore require a larger vent size. For these users, the larger vent size may increase the risk of acoustic feedback, decreasing the gain that can be applied without instability. Significant venting provides more natural, low-frequency response, and can remove the effects of occlusion by allowing low frequency energy to escape from the ear canal, but it opens up a path of ambient noise penetration.

Since a combination of occlusion and amplification is relevant to a wearer's satisfaction of the listening device, it is desirable to a wearer to subjectively select a listening device that includes a vent size that strikes a balance between the occlusion effect and amplification. In view of the foregoing description, the "one size fits all" approach is not ideal with respect to in-ear listening devices. In addition to the discomfort of the occlusion effect, the wearers' subjective preferences and sensitivities to modifications of their own voice by the occlusion effect also varies, with some users tolerating more modification of their own voice than others. In addition, the amount of amplification applied by the listening device to combat hearing impairment or provide desired augmentation varies widely and is dependent on unique characteristics of a user's impairment, for example, defined by an audiogram measurement, or environment.

Medically-prescribed hearing aids are typically fit by a professional, who in the fitting process selects an appropriately sized vent based on perceived and measured needs of the user. However, the need for a professional to select an in-ear listening device to address the subjective hearing requirements of the user limits the commercial availability of the device. Personal sound amplification devices and consumer headphones have similar issues with occlusion and stability, and efforts are being made to expand the availability of medical hearing aids by removing the requirement for a professional fitting.

Provided are a system and method for selecting an ear tip for a hearing aid or other in-ear listening device according to a user-defined balance of occlusion and gain values. Here, a number of ear tips having various vent sizes and/or numbers may be presented to a user, for example, packaged with the listening device for selection by the user. The user is provided an opportunity to select an ear tip having a particular vent configuration by evaluating the different ear tips for performance unique to the user. Here, the user can strike a balance between quality of their own voice and a maximum amount of stable gain. In addition to individual ear tips having different potential leaks, a similar methodology could be used to allow for a single ear tip or an earbud to accept several sizes of vents. A vent is preferably acoustically coupled to the ear canal volume with little impedance at low frequency so the front cavity plastics is just as useful as the ear tip for placing a vent.

Figure 6:
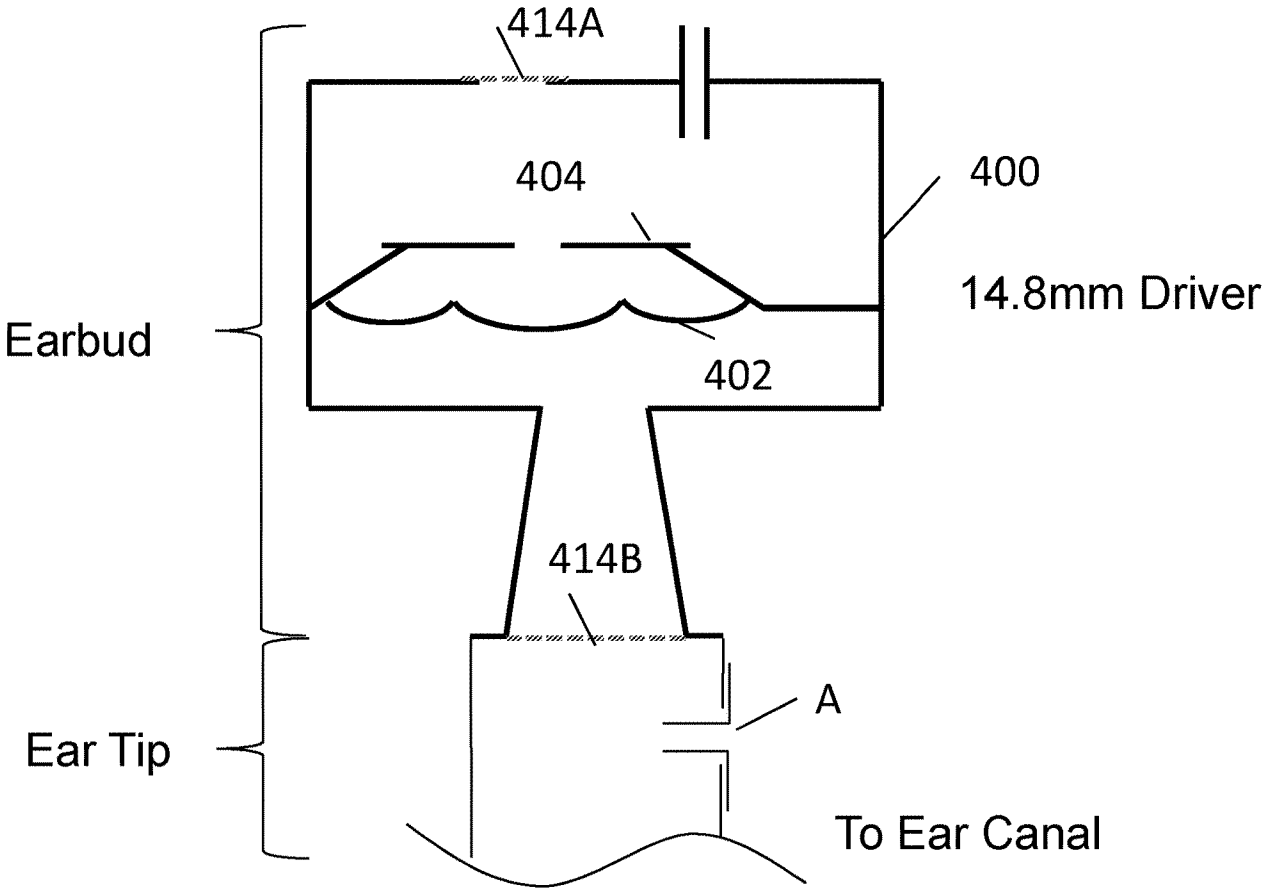
FIGS. 6 and 7 are schematic views of an in-ear listening device including vents positioned to reduce acoustic feedback caused by leakage from the device's transducer, in accordance with some examples.
Figure 7:
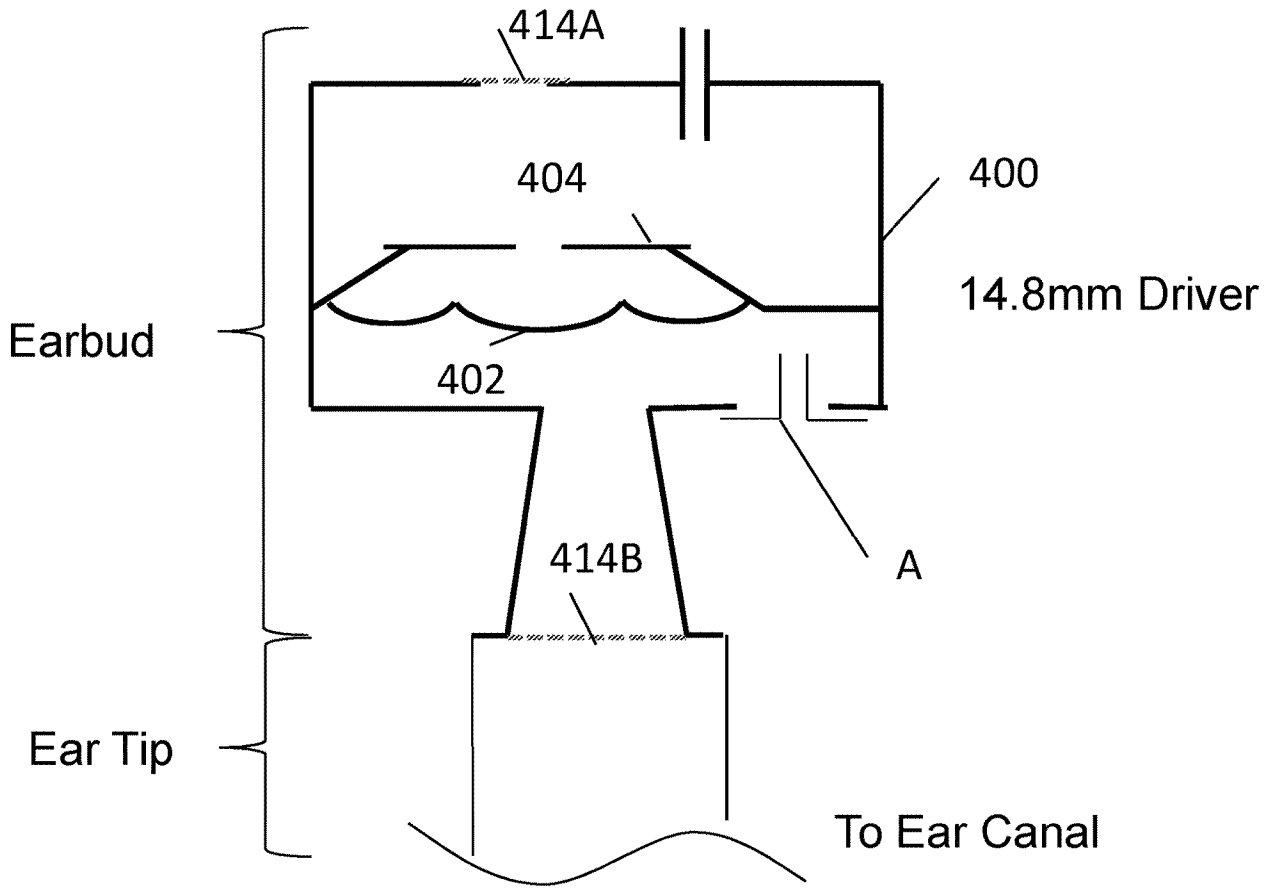

For example, as shown in FIGS. 6 and 7, an acoustic driver 400 of an earbud has a front cavity 402 and a back cavity 404. An ear tip is positioned between the earbud and a wearer's ear canal. A leak (A) is in the ear tip (FIG. 6) or near the front cavity 402 in the earbud. Venting regions 414A, B (generally, 414), also referred to as vent passages, are positioned at the earbud and/or ear tip accordingly.

This allows for multiple combinations of ear tip sizes with vent sizes with a simple summation of parts rather than a multiplication. Users can therefore independently select the proper ear tip size that fits their ear the best and independently select a vent that balances the occlusion and feedback gain they desire, for example, illustrated in the user interface display of FIG. 3.

In some examples, a system is provided that automatically identifies an ear tip, or more specifically, the vent of the ear tip, allowing the self-fitting assistance processing system to automatically update the tuning of one or more parameters such as dynamic range compression parameters, equalization parameters, output limits, bandwidth limits, configuration of a feedback suppressor, a gain limit, feedback and/or feed-forward filter design, and so on. An example of a self-fitting assistance processing system is described in U.S. Pat. No. 9,131,321, incorporated by reference herein in its entirety. Accordingly, the system and method according to these examples may reduce the need for the user or professional to reconfigure an in-ear listening device simply based on the acoustic changes imposed by the different vent size.

In some examples, the system may incorporate a self-fitting technology, for example, operating in connection with a computer processor-executed application that applies signal processing to the sound picked up by the listening device's microphone(s) to enhance the sound, for example, the Bose Hear application from Bose Corporation. Here, the system may generate a result to assist the wearer in an ear tip selection, for example, generating a message for display that "a gain limit has been reached for this ear tip. Please insert another ear tip for more amplification." The message may be more specific, e.g., "please try the blue ear tip,"

where the blue ear tip has a smaller vent than the ear tip the system believes the user is currently trying. In another example, the system may suggest that, given the user has selected a low gain setting, they may find a more open tip more comfortable.

Figure 1:
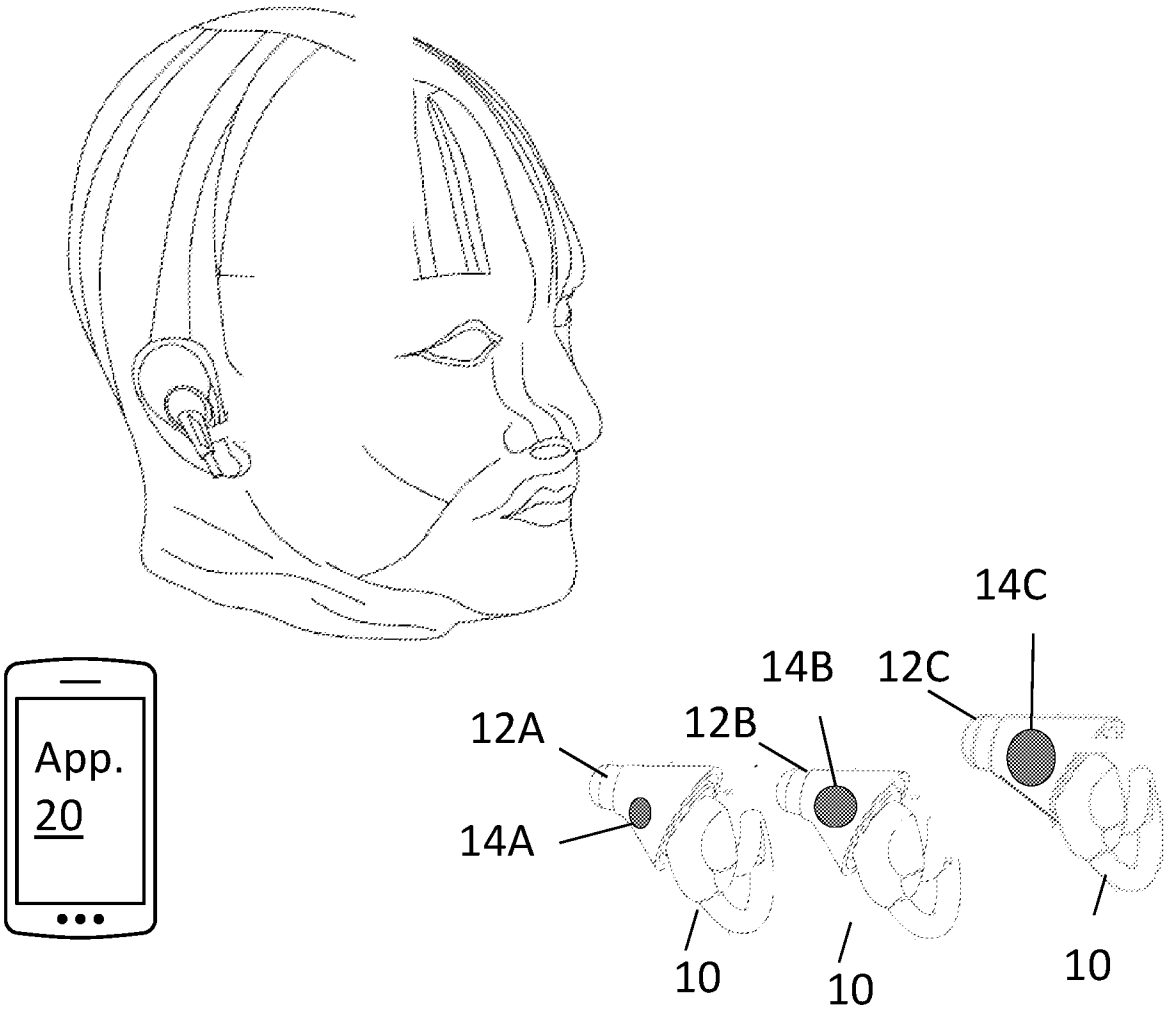
FIG. 1 is a schematic view of an environment in which a user may select an ear tip for an in-ear listening device, in accordance with some examples.

Referring to FIG. 1, a user may be interested in acquiring an in-ear listening device 10 such as a hearing aid. The listening device 10 may include well-known components such as a microphone, battery, volume control, receiver, processor, storage device, and on-off switch (not shown). The listening device 10 may be configured to accommodate one of several different ear tips 12A, 12B, 12C (generally, 12). In some examples, the in-ear listening device 10 is constructed and arranged as an earbud, and one or more customization components may be used with the in-ear listening device 10, for example, ear tip 12 or the like, which when used in combination with the listening device 10 define a controlled amount of venting, i.e., via a vent passage 14 through the ear tip 12. The amount of venting is acceptable based on both the gain allowed by the in-ear listening device 10 and an amount of occlusion experienced by a user Since an ear tip 12 or earbud may include a customization component such as an ear tip vent passage 14 or related component of the earbud 10 that controls dimensions of a passage through the earbud 12, or venting, the user may wish to select an ear tip 12 having a different vent size, number, or other configuration. The ear tips 12 may be of different sizes, shapes, or other configurations relevant to the user's subjective evaluation of the tips 12 in striking a personal balance between quality of their own voice and maximum amount of stable gain. In other examples, a single ear tip 12, for example, 12A, may be configured to support different vent passages, for example, 14A, 14B, or 14C (generally, 14), thereby changing an acoustic characteristic of the ear tip 12.

In addition to a selected ear tip 12, the in-ear listening device 10 includes at least one microphone that picks up the sounds, a processor that enhances the sounds, and a speaker to deliver the sounds. As part of the sound enhancement, the processor may amplify the incoming sound according to an input received from a self-fitting assistance processing system 20, which can control the amount of gain added or reduced. The self-fitting assistance processing system 20 may provide remote control for the listening device 10. The processor of the in-ear listening device 10 may include active noise reduction (ANR) circuitry for blocking out ambient noise, and for adjusting the acoustical impedance of the occlusion at the eardrum and so removes the feeling of the stuffed ear and fullness which is a frequent complaint of hearing aid users.

A user interface of the self-fitting assistance processing system 20 can be used to recommend ear tips, e.g., via a display or audio output. The user interface may include program code that is stored at and executed by a hardware processor of the self-fitting assistance processing system 20. The self-fitting assistance processing system 20 may communicate with the listening device 10 using a wireless technology, such as Bluetooth™ or the like. The processing system 20 may also communicate with the listening device, or an ear tip or earbud, with wires, and imbedded, onboard circuitry and communicates with the user via voice prompts or the like.

The in-ear listening device 10 may include a sensing device that receives and processes signals used for tip and/or vent identification. For example, the sensing device may include an electrical contact circuit, Hall Effect sensor, mechanical switch, or other sensing technology that can uniquely identify the tip and/or vent currently being used. Users will also have a means to identify different ear tips and/or vents. For example, referring to FIGS. 1 and 3, a user can distinguish ear tips 12A-12C according to a color-coded scheme or the like, for example, a "red" tip pertaining to ear tip 12C having a large vent, a "green" tip pertaining to ear tip 12B having a medium vent, and a "blue" tip pertaining to ear tip 12B having a small vent or no vent. When a user places an ear tip on the device, the sensing device is immediately used to update the tuning of several parameters, such as such as dynamic range compression parameters, equalization parameters, output limits, bandwidth limits, configuration of feedback suppressor, a gain limit, feedback and/or feed-forward filter design, and so on. Although users may be given initial guidance in the selection of an ear tip or vent, the device 10 and/or computer processor-executed application can monitor the user's preferred gain over time, and use this information to suggest whether or not a different tip may be appropriate. For example, if a user is using the blue tip 12B with a small vent, but does not ever use the device 10 with significant gain, the device 10 and/or computer processor-executed application may generate and output a recommendation, i.e., electronic message or the like, that the user instead attach the red tip 12C so that the user can experience lower occlusion (e.g. their own voice sounds more natural). Ear tip or vent recommendations may be different for each ear if the user prefers to use different amounts of gain in each ear.

Figure 2:
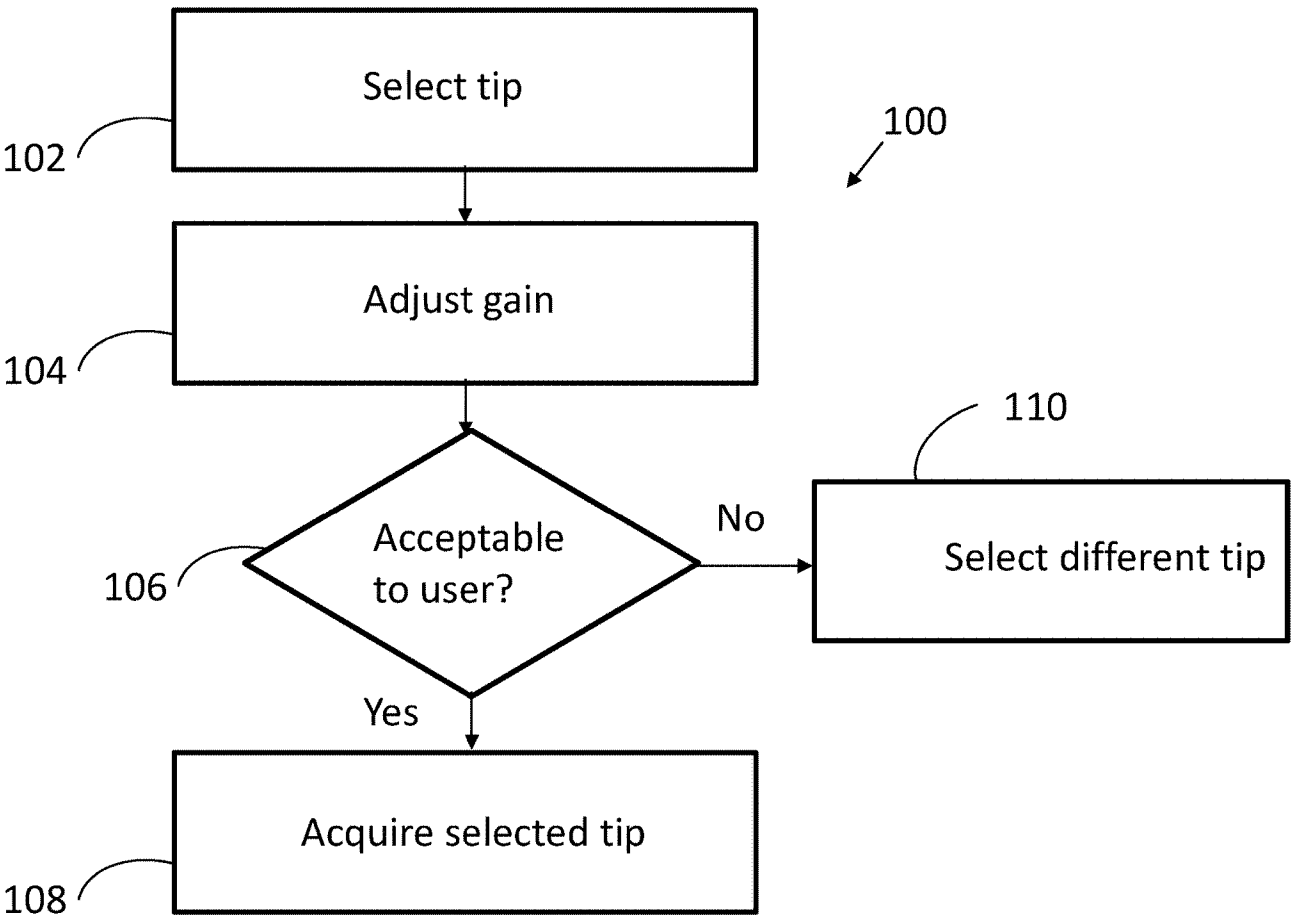
FIG. 2 is a flow diagram of a method for selecting an ear tip for an in-ear listening device, in accordance with some examples.

FIG. 2 is a flow diagram of a method 100 for selecting an ear tip for an in-ear listening device, in accordance with some examples. In describing the method 100, reference may be made to elements of FIGS. 1 and 3. In some examples, the method 100 may be performed by a user. Alternatively, the system of FIG. 1 may provide automatic sensing, which observes whether or not the user has selected an appropriate tip 12, or vent, for the amount of gain that the user is using. As described in other examples herein, if the selection is not appropriate, then the computer application can intervene and suggest that the user change the tip or vent. In other examples, a combination of manual and automatic sensing may be performed. For example, method 100 may be executed when the listening device 10 is first used, while automatic sensing and monitoring of use and recommended changes may occur after initial use. In other examples, automatic sensing only may occur throughout any use of the listening device 10.

At block 102, an ear tip among ear tips 12A-12C is selected. This selected ear tip may be referred to as a default ear tip, from which other ear tips of interest may be compared.

At block 104, the audio gain of the in-ear listening device 10 is adjusted by a gain control device of the device 10, for example, increased. A user with some hearing loss may tolerate more occlusion and can therefore request a higher gain. At decision diamond 106, the user of the selected ear tip 12 determines whether the ear tip 12 is acceptable. If the selected ear tip 12 is acceptable to the user, in particular, the wearer is satisfied with the gain level offered by the listening device 10 including the selected ear tip, then the method 100 proceeds to block 108, wherein the user may acquire the selected ear tip 12, for example, purchases the ear tip 12. Otherwise, the method 100 proceeds to block 110, where a different ear tip 12 may be selected, for example, according to the table 200 shown in FIG. 3.

An example may include a user inserting a listening device 10 having the red ear tip 12C, more specifically, having a large vent size of 3 mm. This particular user may desire more gain and can tolerate some occlusion, and therefore can accommodate an ear tip with a smaller vent size, for example, the green tip 12B, which may have a vent size of 2 mm. This user may opt for more occlusion but in doing so accommodates for higher potential gain.

The table 200 may be displayed at a user interface of the self-fitting assistance processing system 20 for assisting a user in selecting an ear tip for an in-ear listening device, in accordance with some examples. The table 200 may be used to execute some or all of the method 100 of FIG. 2, for example, illustrate a result produced according to the method 100. The table 200 may be used to inform a user of gain selectivity options of the in-ear listening device 10 or a plurality of different frequency bands to match a person's particular hearing loss or other personal preferences. The metrics indicated in the table 200 may be stored at a personal computing device, for example, collocated with the self-fitting assistance processing system 20, or stored at a remote data repository and accessed by the self-fitting assistance processing system 20.

Figure 3:
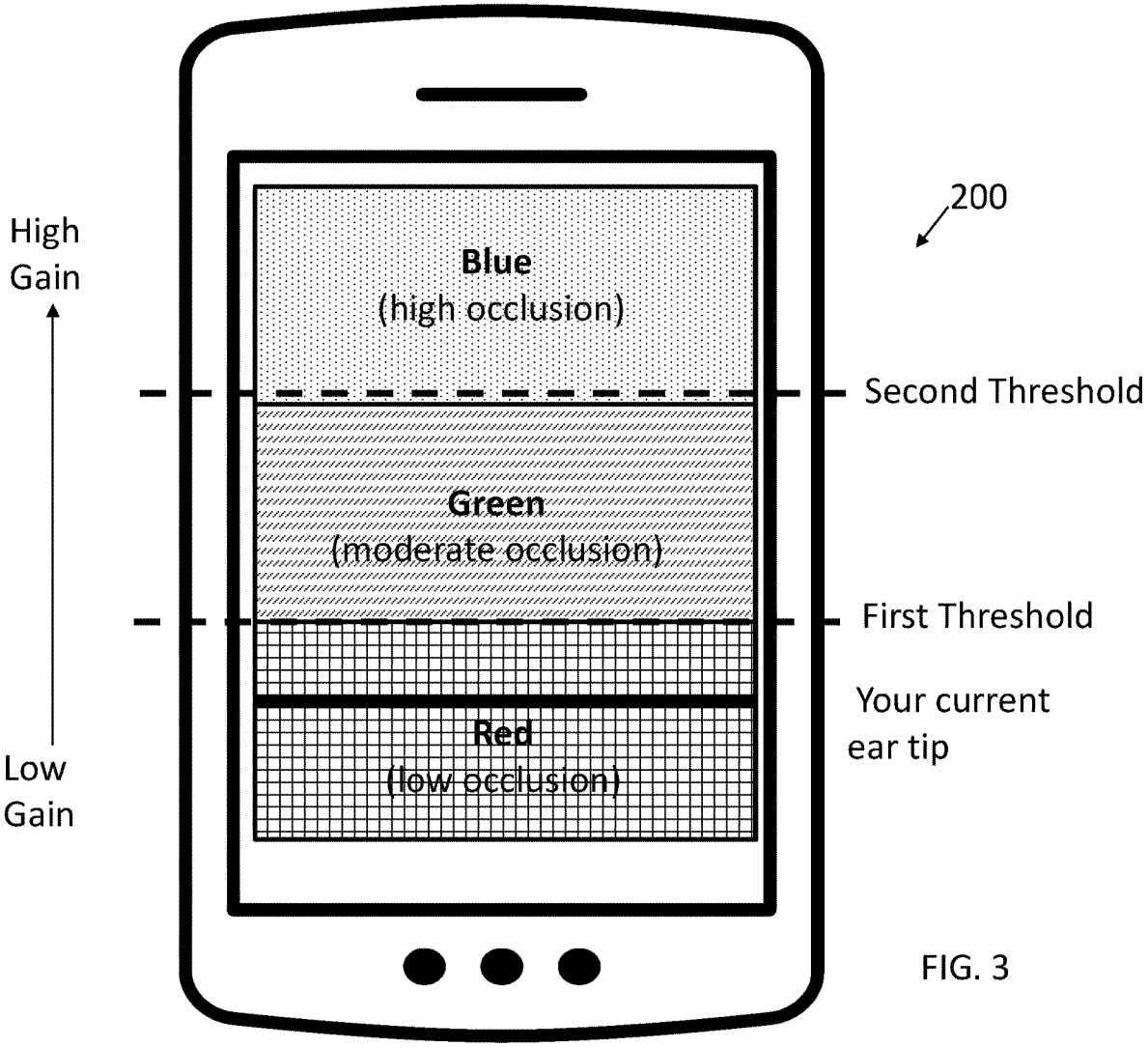
FIG. 3 is a view of a table displayed at a user interface for assisting a user in selecting an ear tip for an in-ear listening device, in accordance with some examples.

The displayed table 200 may be arranged to include a plurality of regions, each corresponding to an ear tip 12 having different characteristics. For example, as shown in FIG. 3, the bottom region of the display may correspond to a red ear tip 12C shown in FIG. 1, which has a large vent, for example, 3 mm, that provides a higher occluding coupling to the ear canal, and reduces occlusion-related effects. However, the red tip 12C also produces less gain added to the incoming sound to the listening device. The red tip 12C may therefore serve as the default tip described in block 102 of method 100 illustrated in FIG. 2.

Some users, in particular, those users experiencing some hearing loss, may be less sensitive to the occlusion effect, and desire to use an ear tip 12, or vent of the currently used ear tip 12, that provides for higher gain than the red tip 12C, i.e., a gain level that is higher than a first gain threshold corresponding to a maximum gain level of the red tip 12C. The first gain threshold may be a preset gain limit. Alternatively, the maximum gain may be adjusted based on the tip 12 that is automatically detected. Here, the user is notified, for example, by an electronic message, that the user should consider changing tips if the user consistently uses the device at or near the gain limit. In a related example, the user may receive a recommendation that a larger vent be used for better occlusion if the system determines that the user does not use high gain. Thus, the user may listen to sounds when the gain of the red tip 12C is less than the first gain threshold, and if not pleased with the result, may be guided to consider a different ear tip, such as the green tip 12B, which has a gain range between the first gain threshold and a second gain threshold. The display in FIG. 3 may inform a viewer of a current status, for example, an indicator identifying a currently worn ear tip 12, or a current gain offered by the listening device 10 as configured by the self-fitting assistance processing system 20 When a gain threshold is reached, the system may provide the user visual feedback, for example, recommendation data regarding the appropriate range of gain for a given tip 12. For example, a message may automatically be displayed with related information for the user.

If a user desires a different configuration, for example, higher gain, then the user can insert the different vent into the current ear tip 12, or select a new ear tip with a different integrated vent size. For example, the green tip 12B having a smaller vent 14B may be selected. The user or the self-fitting assistance processing system 20 via communication with the listening device 10 may identify this selected tip 12B and/or vent 14B, so that the system can process the gain and occlusion capabilities of the selected ear tip 12B. In some examples, the system automatically detects and identifies the tip 12B and/or vent as being the selected tip 12B. The self-fitting assistance processing system 20 can increase the gain at the green tip 12B within a gain range known by the system 20 to be available. The user may now evaluate the green tip 12B in view of the offered gain balanced against the occlusion characteristics of the green tip 12B.

A similar operation may be performed when comparing the green tip 12B to a blue tip 12A, which refers to a tip having a small vent 14A or no vent, and where the highest gain offered, i.e., a second gain threshold corresponding to a maximum gain level of the blue tip 12B among the available ear tips 12A-12C in view of the smallest vent 14A. The high amount of occlusion caused by this ear tip may be unacceptable to individuals with normal hearing or mild hearing loss. However, only users with moderate to severe hearing loss are likely to need the amount of gain allowed with this tip, and high occlusion is less likely to be an issue with these users.

Figure 4:
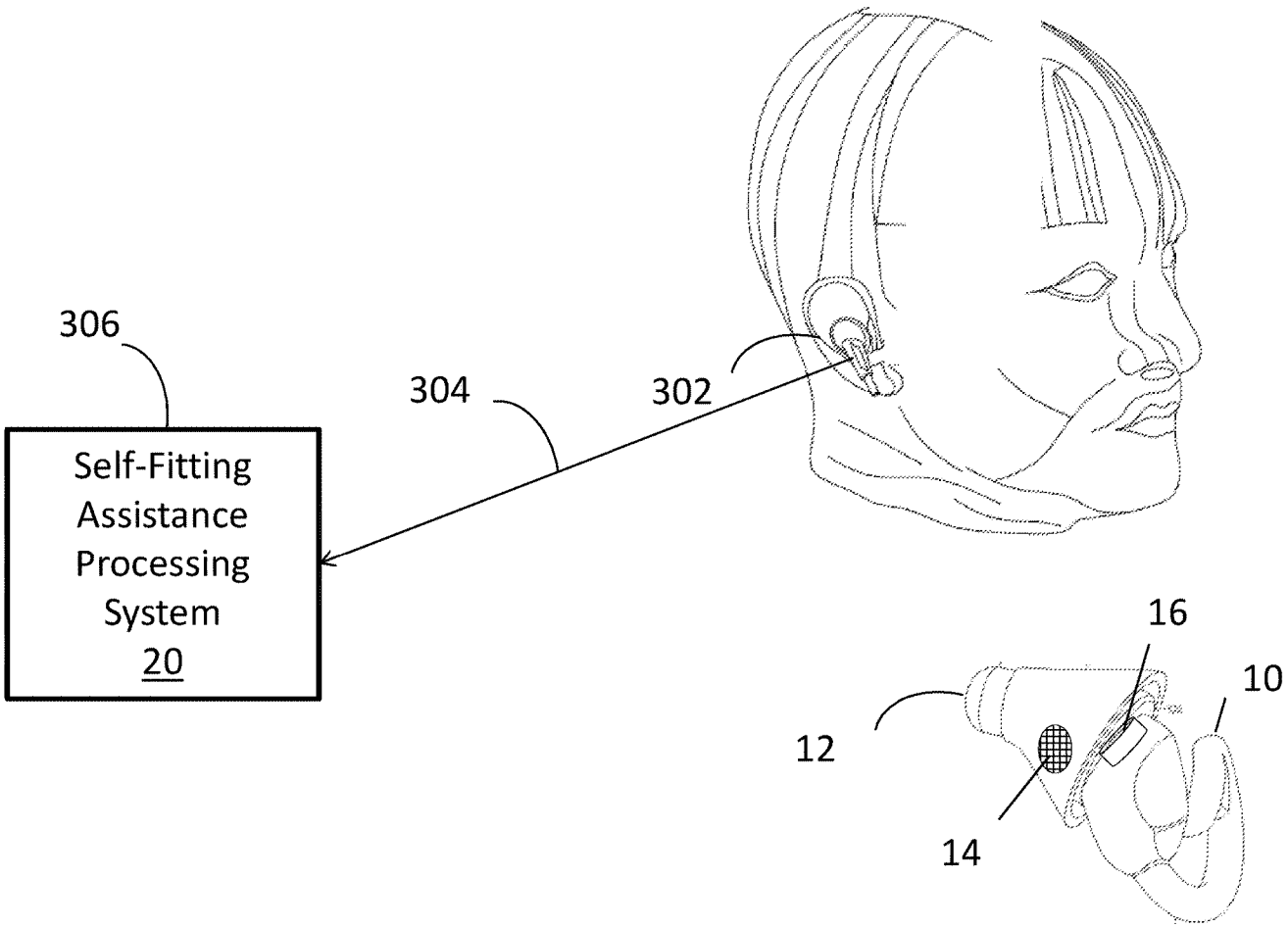
FIG. 4 is a block diagram including a flow path for detecting an ear tip, in accordance with some examples.

FIG. 4 is a block diagram including a flow path for detecting an ear tip, in accordance with some examples.

At step 302, a default ear tip 12, for example, red tip 12C, is inserted into a user's ear. The default tip 12 may be coupled to a listening device 10 which may include well-known components such as a microphone, sound input, battery, volume control, storage device, and on-off switch (not shown). In addition, the listening device 10 may include a sensing device 16 for automatically identifying the ear tip 12, or more specifically, the vent 14 inserted in the ear tip 12. The sensing device may be a Hall Effect sensor, electrical switch, mechanical element, transducer, or other acoustic sensing device that detects the inserted vent 14. The sensing device will output a different electrical signal depending on which leak is installed that can then be interpreted by the processing system. More specifically, the sensing device 16 receives and processes signals for identifying the vent, and determines whether the identified vent is appropriate for the amount of gain determined to be used by the user. A-priori knowledge may be used to gauge whether a vent is appropriate, for example, laboratory measurements made on a group of users wearing different sized vents, resulting in a gain to vent mapping that could be stored in device memory. The mapped data may be modified by detecting a frequency of oscillation or other technique.

At step 304, a signal may be output from the listening device 10 to the self-fitting assistance processing system 20, which includes an identification of the vent 14 inserted in the ear tip 12, since in some examples, the ear tip 12 can accommodate different replaceable vents 14. At block 306, the self-fitting assistance processing system 20 may automatically update tuning parameters, such as dynamic range compression parameters, equalization parameters, output limits, bandwidth limits, configuration of a feedback suppressor, a gain limit, feedback and/or feed-forward filter design, and so on, for example, used to generate the table 200 shown in FIG. 3. Accordingly, the user is not required to reconfigure the listening device 10 based on acoustic changes imposed by the various vent sizes.

In other applications, ear tips or earbuds may be selected according to performance requirements other than gain and occlusion. For example, a user may select a particular vent, for example, a large vent providing for less output at low frequencies, or sealed vent, when the user is listening to music, for example, streamed from a digital electronic device. This application-specific vent may be removed and replaced with a different vent, for example, a closed (or smaller) vent for hearing assistance. The self-fitting assistance processing system 20 may be used to modify the gain configuration accordingly, and may produce a display similar to table 200 in FIG. 3 for accommodate the user's selection process.

What is claimed is:

1. A system for configuring a hearing device, comprising:

an in-ear listening device comprising a first vent passage;

a plurality of customization components for use with the in-ear listening device, each customization component comprising a second vent passage when in combination with the first vent passage of the in-ear listening device cooperating with the listening device to define an amount of venting that is controlled by a configurable and replaceable vent at the second vent passage; and a self-fitting assistance processing device in communication with the in-ear listening device, which adjusts a gain of the in-ear listening device according to the amount of venting provided by a selected one of the customization components, compares the gain of the in-ear listening device to a threshold gain, and displays comparison information of the plurality of customization components at a user interface of the self-fitting assistance processing device.

2. The system of claim 1, wherein the customization components comprise ear tips configured for removably coupling to the in-ear listening device, wherein the controlled amount of venting is controlled by the configurable and replaceable vent of the second vent passage through the ear tip.

3. The system of claim 1, wherein the in-ear listening device is constructed and arranged as an earbud, and wherein the customization component is a component of the earbud that controls dimensions of the second vent passage through the earbud.

4. The system of claim 1, wherein the self-fitting assistance processing system automatically adjusts a tuning parameter.

5. The system of claim 4, wherein the tuning parameter is at least one of a dynamic range compression parameter, equalization parameter, output limit, bandwidth limit, a gain limit, feedback filter design, or feed-forward filter design.

6. The system of claim 1, wherein the user interface displays a recommendation result regarding the selected customization component.

7. The system of claim 1, wherein each of the plurality of customization components has a unique effect on occlusion caused by the in-ear listening device, and the self-fitting assistance processing system balances gain against the occlusion.

8. The system of claim 1, wherein the self-fitting assistance processing device adjusts a gain of the listening device to determine a balance between quality of a voice of a user of the in-ear listening device including the effect of the venting provided by the selected customization component and a maximum amount of stable gain supported by the venting.

9. The system of claim 1, wherein the in-ear listening device includes a processor that enhances a sound received by the in-ear listening device in response to an input received from the self-fitting assistance processing device.

10. The system of claim 1, wherein the self-fitting assistance processing device remotely controls the in-ear listening device.

11. The system of claim 1, wherein the in-ear listening device includes a sensing device that receives and processes signals for identifying the selected customization component.

12. A method for configuring a hearing device, comprising:

selecting and attaching a customization component providing an amount of venting to an in-ear listening device, the in-ear listening device comprising a first vent passage, the customization component comprising a second vent passage when in combination with the first vent passage of the in-ear listening device cooperating with the listening device to define the amount of venting that is controlled by a configurable and replaceable vent at the second vent passage;

adjusting an amount of gain applied to signals by the in-ear listening device according to the amount of venting provided by the selected customization component; and determining whether the amount of venting is acceptable based on both a gain allowed by the in-ear listening device and an amount of occlusion experienced by a user by comparing the gain allowed by the in-ear listening device to a threshold gain, and displaying comparison information of the selected customization component and at least one other customization component at a user interface of the self-fitting assistance processing device.

13. The method of claim 12, further comprising automatically detecting the selected customization component, wherein adjusting the gain comprises adjusting the gain within a gain range limit permitted by the in-ear listening device.

14. The method of claim 12, wherein adjusting the gain of the in-ear listening device comprises:

identifying the customization component that was selected; and adjusting the gain according to an identified amount of venting provided by the customization component.

15. The method of claim 14, wherein the gain is adjusted to determine a balance between quality of a voice of a user of the in-ear listening device including the identified amount of venting and a maximum amount of stable gain supported by the identified amount of venting.

16. The method of claim 14, wherein the in-ear listening device includes a sensing device for automatically identifying the attached customization component.

17. The method of claim 12, further comprising:

performing a combination of manual and automatic sensing, including automatic sensing and monitoring of use and recommended changes after initial use.

18. A hearing device, comprising:

an earbud including an acoustic driver and a first vent passage;

an ear tip constructed and arranged for positioning between the earbud and an ear canal of a wearer, the ear tip comprising a second vent passage;

the combination of the first vent passage of the earbud and second vent passage of the ear tip providing an amount of venting that is controlled by a configurable and replaceable vent at the second vent passage between the ear canal of the wearer and the outside environment; and a gain control device that adjusts a gain of the hearing device according to the controlled amount of venting.

19. The hearing device of claim 18, wherein the controlled amount of venting results in a unique amount of occlusion caused by the hearing device, and wherein the gain control device adjusts a gain of the hearing device to determine a balance between quality of a voice of a user of the hearing device including the occlusion, and a maximum amount of stable gain supported by the controlled amount of venting.

20. The hearing device of claim 18, further comprising a sensing device for automatically identifying the combination of earbud and ear tip and the corresponding controlled amount of venting.

* * * * *